US011262045B2

(12) United States Patent
Mitterlehner

(10) Patent No.: US 11,262,045 B2
(45) Date of Patent: Mar. 1, 2022

(54) CIRCUIT ASSEMBLY, LIGHTING DEVICE, AND VEHICLE HEADLIGHT

(71) Applicant: ZKW Group GmbH, Wieselburg (AT)

(72) Inventor: Thomas Mitterlehner, Mank (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 16/967,569

(22) PCT Filed: Jan. 11, 2019

(86) PCT No.: PCT/EP2019/050607
§ 371 (c)(1),
(2) Date: Aug. 5, 2020

(87) PCT Pub. No.: WO2019/154581
PCT Pub. Date: Aug. 15, 2019

(65) Prior Publication Data

US 2021/0018157 A1 Jan. 21, 2021

(30) Foreign Application Priority Data

Feb. 6, 2018 (EP) ..... 18155280

(51) Int. Cl.
*F21V 7/00* (2006.01)
*F21S 45/47* (2018.01)
(Continued)

(52) U.S. Cl.
CPC ..... *F21S 45/47* (2018.01); *F21S 41/36* (2018.01); *F21S 41/675* (2018.01); *F21S 45/60* (2018.01); *H05B 1/0236* (2013.01); *H05B 3/845* (2013.01)

(58) Field of Classification Search
CPC ..... G02B 26/0833; G02B 6/3518; G02B 6/3584; G02B 7/1815; H01L 2924/1461;
(Continued)

(56) References Cited

U.S. PATENT DOCUMENTS 5,938,319 A 8/1999 Hege
6,969,183 B2 * 11/2005 Okubo ..... B60Q 1/085 362/466

(Continued)

OTHER PUBLICATIONS

International Search Report for PCT/EP2019/050607, dated May 2, 2019 (2 pages).

(Continued)

*Primary Examiner* — Omar Rojas Cadima
(74) *Attorney, Agent, or Firm* — Eversheds Sutherland (US) LLP

(57) ABSTRACT

The invention relates to a circuit assembly (1) comprising a printed circuit board (2), at least one micromirror component (3) which is connected to the printed circuit board (2) for modulating a light beam oriented towards the micromirror component (3), a cooling body which is thermally connected to the at least one micromirror component (3), and a current regulating unit (5). The micromirror component (3) has a heating element (3*a*) which can be controlled by the current regulating unit (5), and the current regulating unit (5) is electrically connected to the heating element (3a) in order to actuate same. The current regulating unit (5) is additionally connected to the micromirror component (3) via a thermal connection to the cooling body (4) in order to transfer heat losses occurring on the current regulating unit (5).

12 Claims, 2 Drawing Sheets

Figure 1:
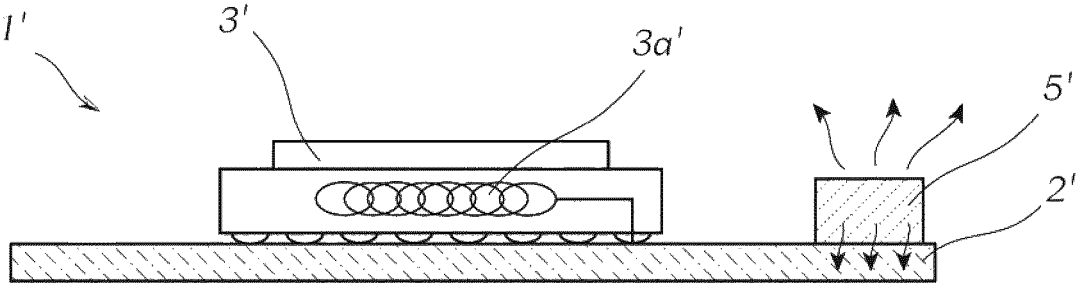

(51) Int. Cl.

| | |
|---|---|
| ***F21S 41/675*** | (2018.01) |
| ***F21S 45/60*** | (2018.01) |
| ***F21S 41/36*** | (2018.01) |
| ***H05B 1/02*** | (2006.01) |
| ***H05B 3/84*** | (2006.01) |

(58) Field of Classification Search
CPC ..... H01L 23/38; H01L 35/00; B81B 7/007; B81B 2201/042; F25B 21/02; H05K 2201/10219; H05K 1/0201; G03B 21/008; F21V 29/67
See application file for complete search history.

(56) References Cited

U.S. PATENT DOCUMENTS

| | | | | |
|---|---|---|---|---|
| 2014/0233086 | A1* | 8/2014 | Oberst | B81B 7/007 359/291 |
| 2016/0195231 | A1 | 7/2016 | Grötsch | |
| 2017/0136939 | A1 | 5/2017 | Mouri et al. | |
| 2019/0316751 | A1 | 10/2019 | Mayer et al. | |
| 2019/0364250 | A1* | 11/2019 | Malfait | G02B 5/003 |
| 2020/0218141 | A1* | 7/2020 | Rafelghem | H05K 7/20336 |

OTHER PUBLICATIONS

Search Report for European U.S. Appl. No. 18/155,280, dated Jul. 31, 2018 (1 page).

* cited by examiner

CIRCUIT ASSEMBLY, LIGHTING DEVICE, AND VEHICLE HEADLIGHT

The invention relates to a circuit assembly, comprising a printed circuit board, at least one micromirror component connected to the printed circuit board for purposes of modulating a light beam of a light source oriented towards the micromirror component, and a cooling body, which is thermally connected to the at least one micromirror component, together with a current regulating unit, wherein a heating element, which can be controlled by means of the current regulating unit, is assigned to the micromirror component, and is thermally connected to the micromirror component.

In this context, the term "modulation" refers to a method in which light can be deflected by selective actuation of the micromirror component, wherein, for example, in one state of a micromirror of the micromirror component, a light beam is projected onto a roadway by way of downstream imaging optics, and in another state the light beam is already previously absorbed. The light distribution and also the intensity can be varied by an intermittent changeover between the states.

The invention furthermore relates to a lighting device with a circuit assembly according to the invention, together with a vehicle headlight with a lighting device according to the invention.

It has become of known art to use imagers as light processing elements for headlight systems, which imagers have a large number of actuatable pixel fields. Thus, DE102013215374A1 shows solutions in which the light from a light source is directed by way of a so-called "taper", a conical light guide element, to an LCD imager, to an LCoS chip, or to a micromirror array ("DMD"), in order to be then projected onto the road by way of projection optics.

DMD is an acronym used for a "digital micromirror device", thus for a micromirror array, or a micromirror matrix. Such a micromirror array has very small dimensions, typically of the order of 10 mm.

In a DMD, micromirror actuators are arranged in the form or a matrix, wherein each individual mirror element can be tilted through a certain angle, for example 20°, for example by electromagnetic or piezoelectric actuators. In this description, the end positions of a micromirror are referred to as ON and OFF states respectively, wherein the ON state means that light from the micromirror reaches the road by way of the imaging optics, whereas in the OFF state it is directed, for example, onto an absorber. A headlight based on a micromirror array is described, for example, in DE 195 30 008 A1.

Micromirror components generally have an operating temperature range, which, without additional measures in vehicle headlight applications, can depart from the permissible operating temperature range during normal operation, wherein in this case a malfunction or consequential damage would occur. In order to limit the working range to the permissible operating temperature range, provision is made in vehicle headlight applications, which, depending upon the application, can be exposed to a high range of fluctuation of ambient temperatures, to connect micromirror components to cooling bodies. This ensures that in the case of high ambient temperatures, the heat loss occurring at a micromirror component does not lead to an unacceptably high component temperature.

At temperatures that are lower than e.g. 0° C., however, the provision of the cooling body could have a negative effect, since the intended operating temperature of a micromirror component also has a lower temperature limit, below which ambient temperatures of 0° C. and less could fall, since in this case the operating temperature approximates to the undesirably low ambient temperature. To prevent the temperature from falling below the permissible operating temperature in the event of low ambient temperatures, the micromirror component therefore has a heating element that is thermally connected to the component, or preferably is integrated into the component.

Since the cooling body acts counter to the heating of the micromirror component, considerable power is required to heat the micromirror component. In addition, the winding resistance of typical integrated heating elements, in DMD chips, is, in particular, highly temperature-dependent, which is why a current regulating unit is provided for purposes of actuating the heating element, that is to say, for controlling the heating power. In accordance with the product of voltage drop $U_{SR}$ and current $I_{Heater}$, losses occur at this current regulating unit, (see FIG. 4), which depend very strongly on the temperature of the heating element.

The power dissipation on the current regulating unit can under certain circumstances reach values similar to the power of the DMD heating element (PHEATER). Heating powers of up to 40 W, for example, are required to heat the micromirror component sufficiently. Losses of the order of 40 W can, for example, therefore occur at the current regulating unit.

An object of the invention is therefore to reduce the power dissipation of the circuit assembly, and to optimise the operation of the micromirror component. This object is achieved with a circuit assembly of the type cited in the introduction, in which, according to the invention, the current regulating unit for the actuation of the heating element is electrically connected to the latter, wherein the current regulating unit is also connected to the micromirror component, by way of a thermal connection to the cooling body, for purposes of transferring the heat loss occurring at the current regulating unit. This makes it possible to use the power dissipation occurring in the current regulating unit to heat the micromirror component, as a result of which the heating power to be implemented in the heating element of the micromirror component can be reduced. This increases the efficiency of the overall system, since in overall terms less energy is required to bring the micromirror component into a permissible temperature range. This improvement in efficiency also makes it possible to dimension conducting paths and cable harnesses supplying the conducting paths—in particular flex connections—to be correspondingly thinner. The light source preferably takes the form of one or a plurality of LED light sources.

The heating element can, for example, be designed as a heating coil. The micromirror component can, for example, be a DMD chip (a digital mirror device), wherein the micromirror component is preferably designed and actuable such that a multiplicity of mirrors can be individually actuated into a switched-on and a switched-off state so as to generate the desired light distribution pattern, which is projected onto the road by way of the projection optics.

The micromirror component can also be designated as a beam deflection unit. A DMD chip can, for example, be designed as a DLP-based light module, wherein such modules can be obtained from the company "Texas Instruments", for example.

Provision can preferably be made for the printed circuit board to have an opening, through which a heat conduction element extends from the micromirror component to the cooling body for purposes of heat transfer. The heat conduction element is thermally connected to the micromirror component and the cooling body. In particular, provision can be made for the heat conduction element to be integrated into the cooling body, or to be formed in one piece with the latter. A heat-conducting paste or a heat-conducting adhesive is preferably arranged between the heat conduction element and the micromirror component for purposes of optimising the heat transfer. The printed circuit board can take the form, for example, of an FR4 printed circuit board that is populated on both sides. Such boards can be produced at low cost, but have a poor thermal conductivity.

For purposes of mounting and referencing the micromirror component within a vehicle headlight, provision can be made, for example, for the circuit assembly further to comprise a support frame that can be connected to a vehicle headlight housing, wherein the printed circuit board is arranged between the cooling body and the support frame. In particular, provision can be made for the support frame to have positioning means for purposes of determining the position of the micromirror component with respect to the support frame.

In particular, provision can be made for the heating element to be integrated into the micromirror component. In this manner, the thermal energy of the heating element can be transferred particularly efficiently to the micromirrors.

Provision can, for example, be made for the current regulating unit to be located on the side of the printed circuit board facing towards the cooling body. In this case the cooling body can make contact with the current regulating unit directly—e.g. by way of its outer housing. Depending on the thermal conductivity of the outer housing, this arrangement can be particularly advantageous.

Alternatively, provision can be made for the current regulating unit to be located on the side of the printed circuit board facing away from the cooling body. This makes it possible, for example, to use printed circuit boards that can be populated on one side. Provision can also be made for the current regulating unit to be thermally connected to the cooling body by way of at least one heat conducting means extending through the printed circuit board, in particular by way of heat conducting vias.

This enables the current regulating unit to make efficient thermal contact with the micromirror component. A via is a so-called "vertically interconnected access", that is to say, a connection extending through the printed circuit board. This arrangement has the particular advantage that the cooling of the current regulating unit, that is to say, the heat transfer to the cooling body, typically takes place particularly efficiently by way of the underside of the current regulating unit, since this is equipped with appropriate metallic contacts, and is connected to the printed circuit board, which metallic contacts extend into the interior of the current regulating unit and thus conduct heat efficiently to the underside.

In particular, provision can here be made for the cooling body to be connected to the support frame in such a way that the printed circuit board can be fixed in its position with respect to the support frame by the cooling body, as a result of which the micromirror component can be fixed in its position with respect to a vehicle headlight housing connected to the support frame, and to components accommodated therein. To facilitate the installation and final positioning of the circuit assembly within a vehicle headlight, provision can be made for the cooling body to be connected to the support frame by means of a screw connection, wherein the cooling body can be relocated along the screw connection, and spring elements are provided, by means of which the cooling body is pressed in the direction of the support frame.

In particular, provision can be made for the current regulating unit to be a linearly regulated current regulating unit, in particular a linear current source. In contrast to pulsed current regulating units, the latter current regulating units are linearly controlled and can be manufactured cost-effectively. Linearly controlled current regulating units have a higher power dissipation in comparison to pulsed control units, which feature, however, can be used advantageously in the context of the present invention, so that the cost-saving potential of the beneficial linear current regulating units can be fully exploited. Possible linear constant current sources include, for example, constant current sources with J-FET, constant current sources with bipolar transistors, constant current sources with operational amplifiers (opamps) and transistors, current mirrors as constant current sources, or constant current sources with linear regulators.

In particular, provision can be made for all the electronic components of the circuit assembly to be SMD components (surface mounted device).

Provision can also be made for at least one socket to be provided on the printed circuit board for purposes of accommodating the at least one micromirror component. In this manner, it is fundamentally possible to install or, for example, replace, the micromirror component at any time during vehicle headlight assembly.

Provision can also be made for the current regulating unit to be located at a maximum distance of 3 cm from the micromirror component.

The invention also relates to a lighting device, comprising a circuit assembly in accordance with the invention, a light source and at least one imaging optic for purposes of imaging the light emitted by the lighting element in a predeterminable light distribution, wherein the light source, the micromirror component and the imaging optics are arranged in such a way that light emitted by the light source can be deflected by way of the micromirror component to the imaging optics.

The invention furthermore relates to a vehicle headlight, in particular a motor vehicle headlight, comprising a lighting device according to one of the preceding claims.

In addition, the invention relates to a vehicle, comprising a vehicle headlight, in particular a motor vehicle headlight, according to the invention.

Figure 2:
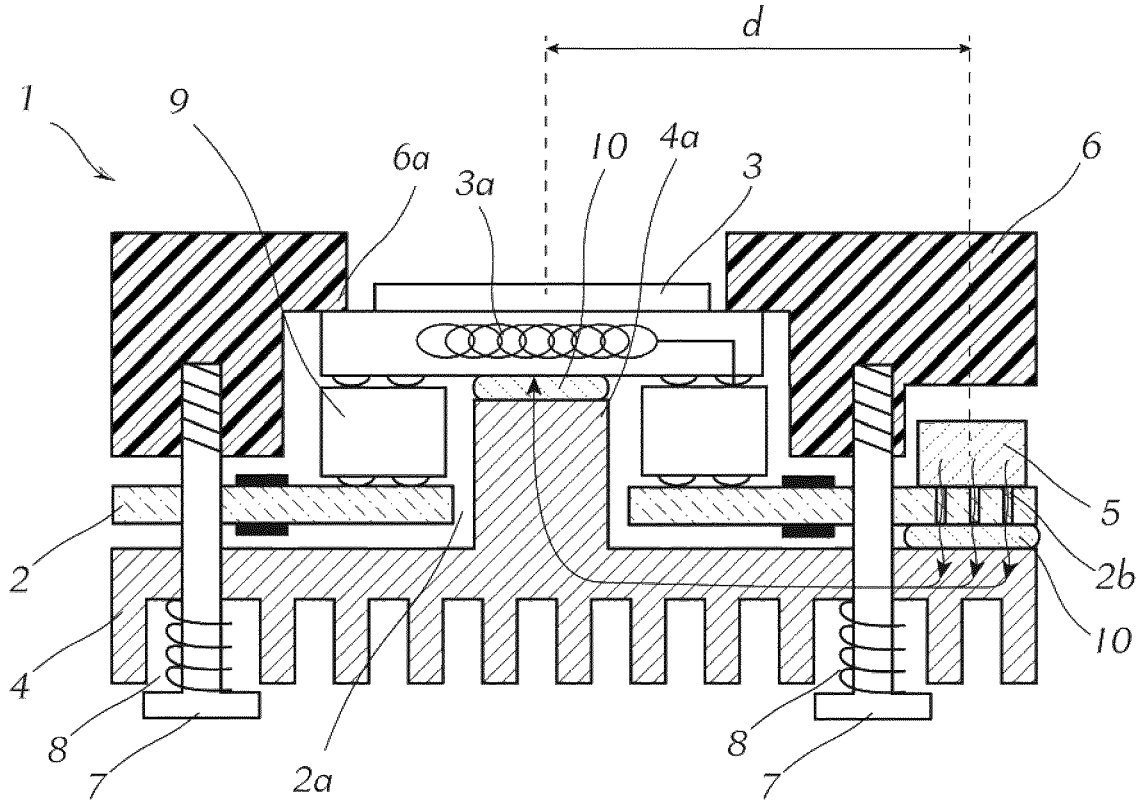
Figure 3:
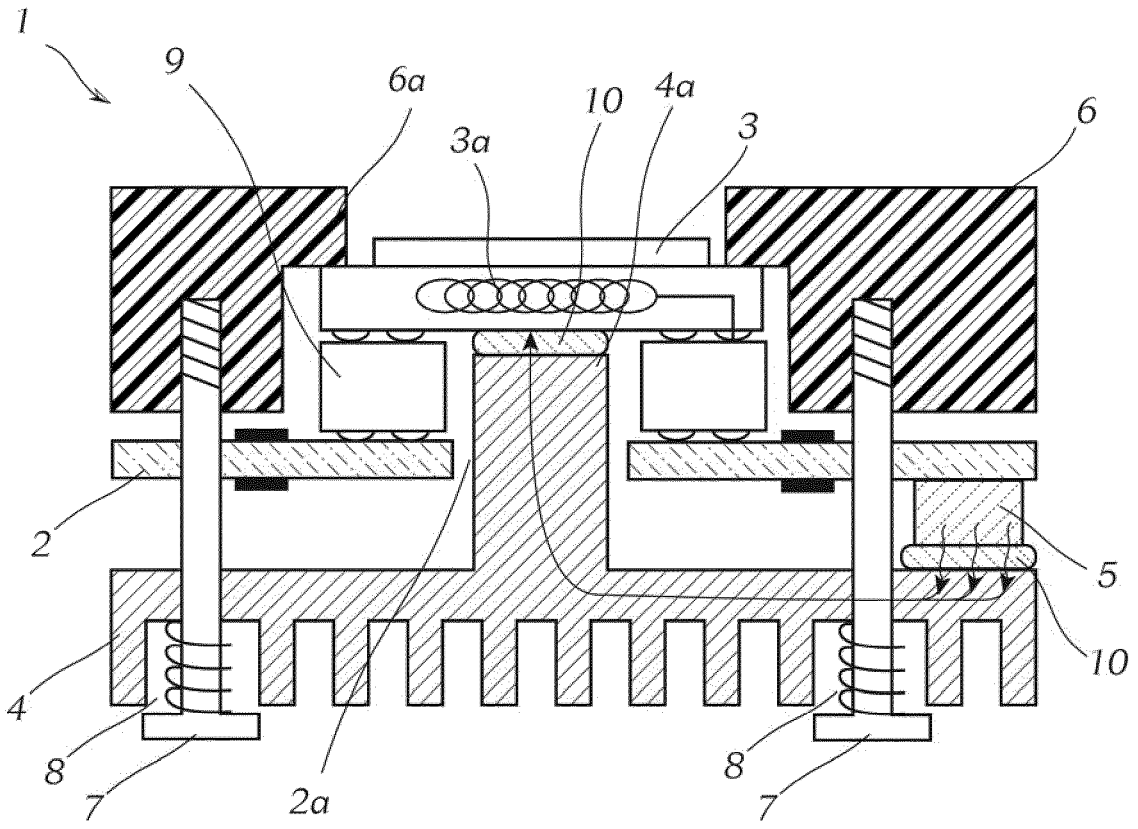
Figure 4:
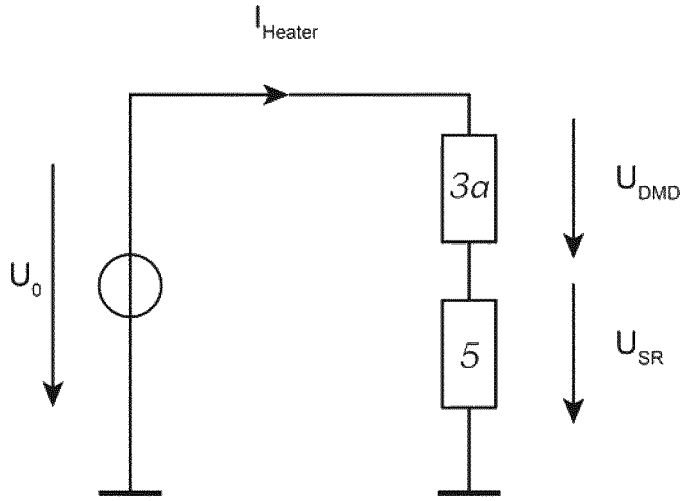

The invention is explained in more detail below by means of exemplary and non-restrictive forms of embodiment, which are illustrated in the figures. Here:

FIG. 1 shows a schematic representation of a circuit assembly according to the prior art, FIG. 2 shows a schematic representation of a first form of embodiment of a circuit assembly according to the invention, FIG. 3 shows a schematic representation of a second form of embodiment of a circuit assembly according to the invention, FIG. 4 shows an equivalent circuit diagram of an electrical circuit, consisting of a heating element of a microprojection element and a current regulating unit.

In the following figures, unless otherwise indicated, identical reference symbols denote identical features.

FIG. 1 shows a schematic representation of a circuit assembly 1' according to the prior art. The circuit assembly 1' comprises a printed circuit board, 2', at least one micromirror component 3', connected to the printed circuit board 2', for purposes of deflecting a light beam directed onto the micromirror component 3', together with a current regulating unit 5'. The micromirror component 3' has an integrated heating element 3*a*', which can be controlled by means of the current regulating unit 5'. The current regulating unit 5' is located on the printed circuit board 2', wherein no structural elements are provided for purposes of a thermal connection to the micromirror component 3'. The heat loss at the current regulating unit 5' thus remains unutilised.

FIG. 2 shows a schematic representation of a first embodiment of a circuit assembly 1 according to the invention. In an analogous manner to the inventive circuit assembly 1 comprises a printed circuit board 2, and at least one micromirror component 3 connected to the printed circuit board 2, for purposes of modulating a light beam directed onto the micromirror component 3. In addition, the circuit assembly 1 comprises a cooling body 4, which thermally connected to the at least one micromirror component 3, and a current regulating unit 5. The micromirror component 3 has an integrated heating element 3*a*, which can be controlled by means of the current regulating unit 5.

In contrast to the circuit assembly 1' according to the prion art, in the circuit assembly 1 the current regulating unit 5, which is electrically connected to the heating element 3*a*, is, according to the invention, thermally connected to the micromirror component 3 by way of a thermal connection to the cooling body 4, for purposes of transferring the heat loss occurring at the current regulating unit 5. For this purpose, the printed circuit board 2 in this example of embodiment has an opening 2*a*, through which a heat conduction element 4*a* extends from the micromirror component 3 to the cooling body 4 for purposes of heat transfer. The heat conduction element 4*a* in this example of embodiment is formed in one piece with the cooling body 4. Heat conducting material 10 (e.g. a heat conducting paste) can be arranged between the cooling body 4 and the printed circuit board 2 to improve the heat transfer. In particular, provision can be made for this heat-conducting material 10 (e.g. "Gapfiller" material from the company Bergquist GF1500) in particular to be designed for purposes of conduction over greater distances (in the millimetre range), wherein the material is arranged in the region between the printed circuit board 2 and the current regulating unit 5. This material can also be arranged between the micromirror component 3 and the heat conduction element 4*a*. Alternatively, a conventional heat conducting paste or heat conducting adhesive can be used for this purpose.

The circuit assembly 1 further comprises a support frame 6 that can be connected to a vehicle headlight housing (not shown in the figures), wherein the printed circuit board 2 is arranged between the cooling body and the support frame 6. The support frame 6 comprises positioning means 6*a* designed as projections in order to establish the position of the micromirror component 3 with respect to the support frame 6.

The electronic components of the circuit assembly are arranged both on the side of the printed circuit board 2 facing towards the support frame 6, and also on the side facing away, wherein the current regulating unit 5 is thermally connected to the cooling body 4 by way of at least one heat conducting means 2*b*, in particular heat conducting vias, extending through the printed circuit board 2.

The cooling body 4 is connected to the support frame 6 in such a way that the printed circuit board 2 can be fixed in its position with respect to the support frame 6 by the cooling body 4. This is achieved in the present example of embodiment by connecting the cooling body 4 to the support frame 6 by means of a screw connection 7, wherein the cooling body 4 can be relocated along the screw connection 7, and spring elements 8 are provided, by means of which the cooling body 4 is pressed in the direction of the support frame 6.

A socket 9 is arranged on the printed circuit board 2, which socket is provided to accommodate the micromirror component 3, and by way of which the micromirror component 3 is electrically connected to the printed circuit board 2.

In order to transfer the heat loss occurring at the current regulating unit 5 as completely and quickly as possible to the micromirror component 3, provision can be made for the distance between the micromirror component 3 and the current regulating unit to be a maximum of 3 cm (as measured from the centres of the elements in the direction of the plane spanned by the printed circuit board 2).

The invention also relates to a lighting device, not shown in detail in the figures, comprising a circuit assembly 1 according to the invention, a light source, together with at least one imaging optic (the light source and the imaging optic are not shown in the figures) for purposes of imaging the light emitted by the lighting element into a predeterminable light distribution, wherein the light source and the micromirror component are arranged in such a way that light emitted by the light source can be directed by way of the micromirror component to the imaging optics, in particular a projection device (a lens). The invention furthermore relates to a vehicle headlight, in particular a motor vehicle headlight, comprising a lighting device according to the invention, together with a vehicle comprising a vehicle headlight according to the invention, in particular a motor vehicle headlight.

FIG. 3 shows a schematic representation of a second form of embodiment of a circuit assembly according to the invention 1. In contrast to the first form of embodiment, the current regulating unit 5 is arranged on the underside of the printed circuit board 2, wherein the cooling body 4 makes contact with the current regulating unit 5 directly on its housing by means of a heat conducting material.

FIG. 4 shows an equivalent circuit diagram of an electrical circuit, consisting of the heating element 3*a* of a micro-projection element 3, and a current regulating unit 5. The equivalent circuit shows a voltage source $U_0$, by way of which the current regulating unit 5 and the heating element 3*a* are supplied. The voltage $U_0$ is divided into the voltages $U_{DMD}$ and $U_{SR}$, wherein the ratio of these voltages is predetermined depending on the nature of the heating element, the ambient temperature, as well as the properties of the regulator 5 and its operating state. As already mentioned in the introduction, the power dissipation at the controller 5 may well assume the same values as the heat output of the heating winding. In this case $U_{SR}=U_{DMD}$ therefore applies, wherein the power dissipation $P_{SR}=I_{Heater}*U_{SR}$, and $P_{DMD}=I_{Heater}*U_{DMD}$. In that, according to the invention, the power dissipation $P_{SR}$ occurring at the current regulating unit 5 is used to heat the micromirror component 3, the heating power $P_{DMD}$ and thus the total energy requirement for heating the micromirror component 3 can be reduced.

In view of this teaching, the person skilled in the art is able to arrive at other, not shown, embodiments of the invention without any inventive step. Individual aspects of the invention or the embodiment are taken up and combined with each other. Any reference symbols in the claims are exemplary, and serve only to make the claims easier to read, without restricting them.

The invention claimed is:

1. A circuit assembly (1) comprising:

a printed circuit board (2);

at least one micromirror component (3) connected to the printed circuit board (2) and configured to modulate a light beam of a light source directed onto the micromirror component (3);

a cooling body (4) thermally connected to the at least one micromirror component (3);

a current regulating unit (5);

a support frame configured to be connected to a vehicle headlight housing; and spring elements, wherein a heating element (3*a*) is assigned to the micromirror component (3), which heating element is configured to be controlled by the current regulating unit (5) and is thermally connected to the micromirror component (3), wherein the current regulating unit (5) is electrically connected to the heating element and configured to actuate the heating element, wherein the current regulating unit (5) is also connected to the cooling body (4) by way of a thermal connection to the micromirror component (3) and configured to transfer heat loss occurring at the current regulating unit (5), wherein the printed circuit board (2) is arranged between the cooling body (4) and the support frame (6), and the support frame (6) has positioning means (6*a*) configured to establish the position of the micromirror component (3) with respect to the support frame (6), wherein the cooling body (4) is connected to the support frame (6) by a screw connection (7) such that the printed circuit board (2) can be fixed in its position with respect to the support frame (6) by the cooling body (4), and the cooling body (4) can be relocated along the screw connection, and wherein the spring elements (8) press the cooling body (4) in the direction of the support frame (6).

2. The circuit assembly (1) according to claim 1, wherein the printed circuit board (2) has an opening (2*a*), through which a heat conduction element (4*a*) extends from the micromirror component (3) to the cooling body (4) for purposes of heat transfer.

3. The circuit assembly (1) according to claim 1, wherein the heating element (3*a*) is integrated into the micromirror component (3).

4. The circuit assembly (1) according to claim 1, wherein the current regulating unit (5) is arranged on the side of the printed circuit board (3) facing towards the cooling body (4).

5. The circuit assembly (1) according to claim 1, wherein the current regulating unit (5) is arranged on the side of the printed circuit board (3) facing away from the cooling body (4).

6. The circuit assembly (1) according to claim 5, wherein the current regulating unit (5) is thermally connected to the cooling body (4) by way of at least one heat conducting means (2*b*) extending through the printed circuit board (2), in particular at least one heat conducting via.

7. The circuit assembly (1) according to claim 1, wherein the current regulating unit (5) is a linearly regulated current regulating unit.

8. The circuit assembly (1) according to claim 1, wherein all electronic components (3, 5) of the circuit assembly (1) are SMD components.

9. The circuit assembly (1) according to claim 1, wherein at least one socket (9) is provided on the printed circuit board (2), for purposes of accommodating the at least one micromirror component (3).

10. The circuit assembly (1) according to claim 1, wherein the current regulating unit (5) is arranged at a maximum distance (d) of 3 cm from the micromirror component (3).

11. A lighting device, comprising:

the circuit assembly (1) according to claim 1;

a light source; and at least one imaging optic for purposes of imaging the light emitted by the lighting element into a predeterminable light distribution, wherein the light source, the micromirror component (3) and the imaging optics are arranged in such a way that light emitted by the light source can be deflected by way of the micromirror component (3) towards the at least one imaging optics.

12. A motor vehicle headlight comprising the lighting device according to claim 11.

* * * * *